US005890428A

United States Patent [19]

Hetz

[11] Patent Number: 5,890,428

[45] Date of Patent: Apr. 6, 1999

[54] STATIC CLING STENCIL METHOD

[76] Inventor: Mary B. Hetz, 333 N. Acacia Ave., Solana Beach, Calif. 92075

[21] Appl. No.: 867,615

[22] Filed: Jun. 2, 1997

[51] Int. Cl.[6] ..... B41M 1/12; B41F 15/02

[52] U.S. Cl. ..... 101/129; 101/35

[58] Field of Search ..... 101/127, 129, 101/35

[56] References Cited

U.S. PATENT DOCUMENTS

| | | | |
|---|---|---|---|
| 2,241,380 | 5/1941 | Gfeller | 101/127 |
| 2,340,643 | 2/1944 | Campbell | 101/129 |
| 3,582,730 | 6/1971 | Testone | 317/262 |
| 4,295,275 | 10/1981 | Cugini, Sr. et al. | 33/1 |

FOREIGN PATENT DOCUMENTS

| | | | |
|---|---|---|---|
| 7217366 | 7/1973 | Netherlands | 101/129 |
| 447302 | 5/1936 | United Kingdom | 101/129 |

*Primary Examiner*—Edgar Burr
*Assistant Examiner*—Amanda B. Sandusky
*Attorney, Agent, or Firm*—Arthur F. Holz

[57] ABSTRACT

A method of transferring a decorative stenciled image to an irregular object utilizes flexible plastic static cling sheet material as the stencil medium. The cutout stencil is shaped approximately to the size of the surface of the object that will receive the image and conforming the stencil medium to the surface smoothly, adhering the sheet material such that the static cling attribute of the material will bond to the object's surface without lifting or breaking that would cause gaps or bubbles. The method is completed by well-known steps of applying stencil ink or paint by brush or other suitable applicator, removing the stencil medium and optionally curing the image by baking or other fixation step.

7 Claims, 1 Drawing Sheet

FIG. 1
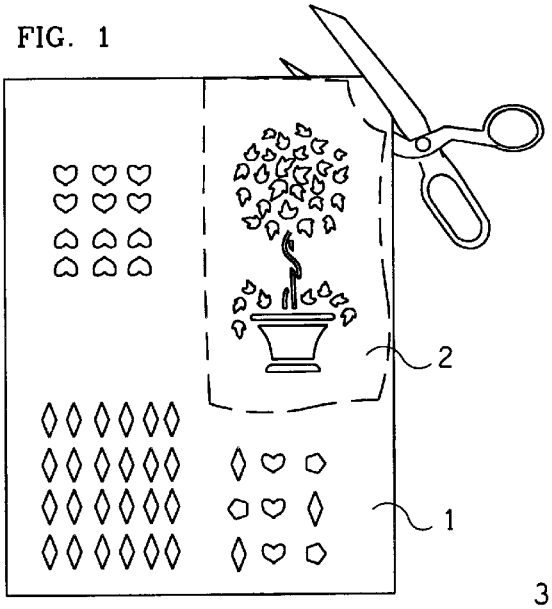
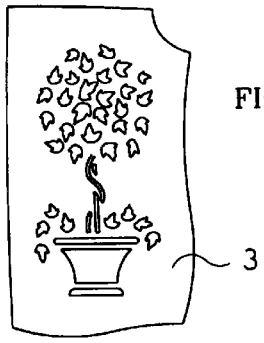
FIG. 2
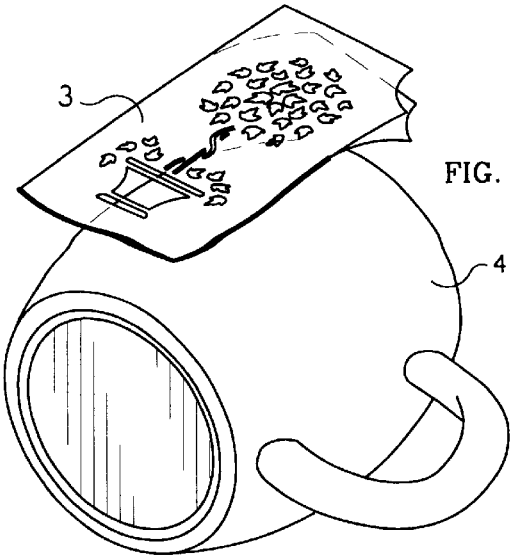
FIG. 3
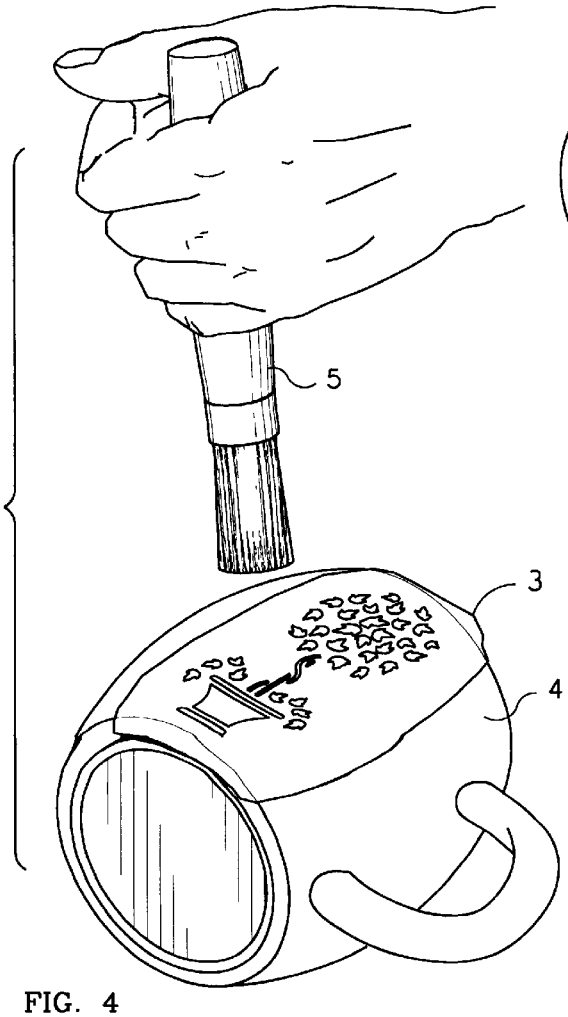
FIG. 4
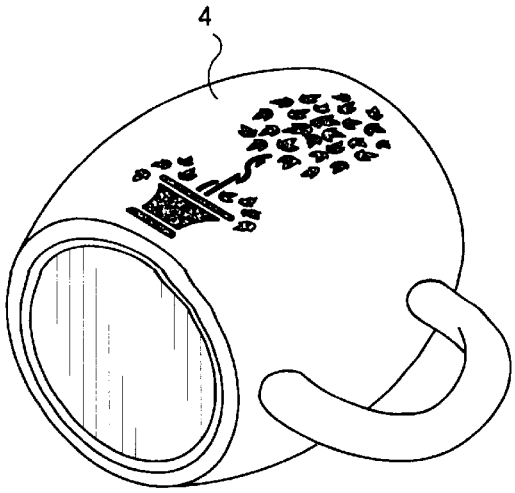
FIG. 5

STATIC CLING STENCIL METHOD

BACKGROUND OF THE INVENTION

Decorative stenciling by applying paint or ink through patterned cutouts in sheet or screen material has long been popular both as a home craft method and as a limited or custom production method for small articles. Properly done, stenciling can accurately and repetitively transfer simple and complex artistic and graphic patterns and lettering to a variety of small objects, enhancing the attractiveness of the objects. Many such objects may be the subject of application of decorative designs by transfer of liquid or semi-solid artistic media to the surface of the object and fixing the media to the object by curing, drying or baling. In particular, ceramic, metallic and glass objects are suitable for application of decorative stencil patterns by reason of the relatively smooth exterior surfaces they offer to receive and display the designs as the object is in use.

A critical factor in proper application of a stencil design is adherence of the sheet stencil medium to the surface of the object to receive the design. Flat surfaces on objects present little problem, as the flat stencil sheet can be closely pressed to the flat object and, if necessary, secured by tape or other clamping-type pressure during the application of the stencil design, typically by brush or other flexible applicator that will carry the fluid art media to the surface through the stencil cutout. However, curved or irregular surfaces are far more difficult to achieve the necessary close adherence of stencil sheet medium to object surface. Even more difficult is an object with an outside corner that the stencil must wrap around. Since the stencil sheet medium is provided in flat format, bending the medium to a curved surface deforms the sheet medium which will then tend to lift away from the object surface. If the stencil design is not tightly fitted to the object surface, ink or paint will leak and spread under the stencil when applied, resulting in an unacceptably poor image due to smudging, blurring and inexact lines.

The present invention is expressed herein as a method of applying a stencil design utilizing a novel stencil sheet material that enhances the exact adherence of the stencil pattern to the surface of the object to be decorated.

FIELD OF THE INVENTION

The invention is in the field of decorative stencils and stenciling methods, and in particular application of stencil cutout designs to ceramic, glass and metal objects utilizing static cling sheet plastic material.

DESCRIPTION OF THE RELATED ART

This invention addresses the problem of adherence of a stencil pattern to the surface of an object to be decorated, and is especially applicable to objects with a glossy surface such as glass, metal, formed plastic or ceramic. While sheet stencil patterns have been traditionally provided on a variety of materials such as paper, cardboard, metal and plastic sheet material such as mylar, the materials have also typically required additional materials or substances to adhere the stencil to the object surface in all but completely flat applications. These means of adherence have included adhesive tape, glue, clamps and manual pressure, all with drawbacks or imperfect design application. The residues left by tape or glue are obviously undesirable, especially where the liquid art medium applied must be fired or baked. Clamping and pressure methods can be ineffective if the object surface is irregular or curved. Taping the edges of the stencil pattern is particularly ineffective, as the adherence of the interior edges of the cutout design cannot be taped without blocking the stencil application, and precise application of the ink or paint at these interior edges is made critically difficult.

Thus it is an objective of the within invention to provide a method of decorative stencil pattern application to an irregular object that will achieve complete adherence of the stencil material to the object surface.

Another objective of the within invention is to define a stencil sheet material medium that will adhere to an object surface without use of auxiliary means to achieve adherence, such as tape, glue or clamps.

An additional objective is to provide a stenciling method that will leave no foreign residue on the object surface after the stencil is removed.

A still further object is to illustrate a method of achieving perfect registration of a stencil design on an object surface that will remain unmoved during the art medium application.

Yet another objective is to provide a stenciling method that will prevent leaking or inexact art medium application through the stencil cutout by adequate adherence of the stencil sheet medium around every edge of the cutout design including all interior and exterior edges. The invention also addressed the objective of smooth, uniform application and adherence of the sheet medium of the stencil to a curved or irregular surface without lifting or tending to lift from the surface.

A final objective of the stenciling method is to utilize a stencil sheet medium that will lift cleanly from the object surface after stencil design application without significant stretching or movement that would blur or disturb the applied ink or paint lines.

BRIEF SUMMARY OF THE INVENTION

Extensive experimentation by the declarant with various stenciling methods, including testing of numerous stencil cutout sheet media that might address the objectives stated above, has resulted in the conclusion and discovery that plastic flexible sheet material that exhibits clinging properties due to a small but significant static charge differential between the sheet material and object of application will satisfactorily adhere to a variety of materials and curved surfaces including porous and irregular shapes. This material known familiarly as "static-cling" plastic is in common usage in various applications such as window signs and stickers which utilize its clinging properties to conveniently place removable designs on flat glass surfaces.

Suitable static cling plastic sheet material is widely available in a range of weights, stiffnesses, colors and coatings. The plasticizers added to these materials during manufacture usefully increase the pressure sensitivity of material for stencilling purposes. A typical such material is Hi-Stat (tm) vinyl film product offered in weights from 4.0 mil to 8.0 mil by Catalina Plastics Coating Corporation, typically provided in sheets or rolls with a white board backing and typically in clear transparent or white translucent form. These weights of static cling sheet material are found to be especially suitable for the stenciling method described herein because they exhibit sufficient flexibility to conform to curved and irregular surfaces, yet also is sufficiently stiff to maintain the integrity of the cutout design when the stencil is laid against the object surface. Further experimentation has found that vinyl plastic sheet material can be used for the described purposes in weights between 3.0 to 10.0 mils.

The static cling material will adhere to glossy surfaces in its ambient state, but the cling effect and consequent strength of adhesion may also be increased by rubbing the material with a fabric material to increase the static charge differential. Utilization of static cling plastic sheet material as the stencil cutout medium has allowed development of a stenciling method that eliminates steps of securing the stencil by auxiliary means or pressure, since the stencil will securely cling to the surface of the object at every point of contact including the edges of complex cutout designs. The adherence achieved by use of static cling material has also been found to be sufficient to prevent movement of the stencil that may otherwise be caused or urged by pressure of application of the art medium, as by brush or squeegee.

Besides the objectives listed above, it has also been found that use of static cling plastic material offers other unexpected advantages in stenciling applications. One is that the stencil patterns can be repeatedly reused, as the material is durable and does not deform or degrade in the application process. Another is that the transparent or translucent nature of the static cling material allows accurate positioning of the design by viewing the object surface through the material when applied, and allowing accurate adjusted repositioning if necessary. Another is that designs can be quickly modified by the artist by masking off portions of the stencil cutout, using scraps of the static cling material cut from the sheet edges, which themselves will cling where applied without adhesives.

BRIEF DESCRIPTION OF THE DRAWINGS

FIG. 1 illustrates a typical cutout stencil pattern on a flexible sheet medium, and illustrates the first step of the method which is cutting a selected decorative pattern.

FIG. 2 illustrates the selected stencil pattern cut to the approximate size of the area to receive the stencil pattern.

FIG. 3 illustrates placement of the flexible stencil medium on a compound curved surface.

FIG. 4 illustrates the application of the selected design to the object through the stencil pattern via a stencil brush and paint.

FIG. 5 shows the stenciled object with the stencil medium removed and ready for curing.

DETAILED DESCRIPTION OF THE INVENTION

Referring now to the drawings, FIG. 1 illustrates the complete stencil design cutout sheet 1, which is provided in precisely die-cut shapes in sheet plastic material of the described static-cling type. Unless the entire sheet is to be used in the size provided, the first step in the method of the invention is cutting out the selected design 2 from the sheet to a sized sheet 3 as shown in FIG. 2 that approximates the size of the surface area of the object to which the stencil pattern is to be applied.

FIG. 3 illustrates the next step of applying the stencil to a surface of an object, here shown as a coffee cup 4 with a surface curved both in circumference and in vertical dimension. The doubly curved surface illustrates the difficulty of adhering a flat stencil medium to it, which the flexible plastic sheet material addresses by conforming bendably in all directions and achieving secure adherence by the static charge differential between the plastic material and the solid object surface. The stencil material is smoothed to the object surface by rubbing or pressing with an applicator or with the artist's fingertips until complete adherence of the stencil material to the object surface is achieved, all air bubbles are removed, any lifted areas are placed firmly to the surface and all edges both exterior and interior to the design are exactly adjacent to the surface.

In FIG. 4, the stencil sheet medium is closely adhered to the object surface at all points of contact including the interior design edges and the exterior sheet edges alike. The art medium such as ink, ceramic glazing or paint is applied to the object surface through the stencil cutout by means such as the brush 5 as illustrated.

FIG. 5 illustrates the object coffee cup surface with the stencil cutout sheet medium cleanly peeled away leaving a precisely applied design, ready for use or curing if necessary.

What is claimed is:

1. A method of application of a design to an object surface comprising:

selecting a cutout stencil design which has been pre-cut in a static cling plastic sheet medium, shaping the portion of said sheet medium containing the selected design to the approximate area of the object surface, smoothing said sheet medium to achieve adherence of said sheet medium to the object surface at all points of contact, applying a fluid art medium to the object surface through the cutout stencil design, and removing said cutout stencil by peeling the said static cling plastic sheet away from the object surface.

2. The method of claim 1 wherein the step of shaping the portion of said sheet medium is selecting the entire sheet.

3. The method of claim 1 wherein the step of shaping the portion of said sheet medium is cutting a section of the entire sheet away.

4. The method of claim 1 wherein the fluid art medium is ink.

5. The method of claim 1 wherein the fluid art medium is paint.

6. The method of claim 1 wherein the fluid art medium is ceramic glazing.

7. The method of claim 1 further including the step of increasing adhesions of the stencil to the object surface by rubbing the stencil sheet medium on a fabric surface to increase the static cling effect.

* * * * *